US005827051A

United States Patent [19]

Smith

[11] Patent Number: 5,827,051

[45] Date of Patent: Oct. 27, 1998

[54] REGENERATIVE HYDRAULIC POWER TRANSMISSION FOR DOWN-HOLE PUMP

[75] Inventor: Norris Edward Smith, Lufkin, Tex.

[73] Assignee: Air-Go Windmill, Inc., Lufkin, Tex.

[21] Appl. No.: 572,197

[22] Filed: Dec. 13, 1995

[51] Int. Cl.[6] ..... F04B 47/04

[52] U.S. Cl. ..... 417/904; 417/375; 60/414

[58] Field of Search ..... 417/375, 15, 904, 417/420; 60/414, 413

[56] References Cited

U.S. PATENT DOCUMENTS

| | | | |
|---|---|---|---|
| 1,031,362 | 7/1912 | Mohr . | |
| 1,588,784 | 6/1926 | Trout . | |
| 2,073,809 | 3/1937 | Salentine | 417/904 |
| 2,299,692 | 10/1942 | Goehrig | 417/904 |
| 2,555,426 | 6/1951 | Troutman . | |
| 3,029,650 | 4/1962 | Byrd . | |
| 3,939,656 | 2/1976 | Goldfein | 417/904 |
| 4,299,545 | 11/1981 | Bever . | |
| 4,474,002 | 10/1984 | Perry . | |
| 4,512,149 | 4/1985 | Weaver . | |
| 4,534,168 | 8/1985 | Brantly . | |
| 4,707,993 | 11/1987 | Kime | 60/414 |
| 4,724,672 | 2/1988 | Olmsted | 60/414 |
| 4,762,473 | 8/1988 | Tieben . | |
| 5,481,873 | 1/1996 | Saruwatari . | |

FOREIGN PATENT DOCUMENTS

| | | | |
|---|---|---|---|
| 4941C03 | 4/1977 | Russian Federation | 417/904 |
| 661144 | 5/1979 | U.S.S.R. | 417/904 |

OTHER PUBLICATIONS

Product Brochure, undated, entitled Mannesmann Rexroth Model AA4VSG Variable Displacement Pump.

*Primary Examiner*—Timothy Thorpe
*Assistant Examiner*—Cheryl J. Tyler

[57] ABSTRACT

Regenerative hydraulic power transmission for subsurface pumps, including a power source, a variable flow rate hydraulic pump, means to reverse flow through the hydraulic pump responsive to change in direction of the subsurface pump stroke, and an inertial assist for the power source which gathers energy from the downstroke of the subsurface pump and utilizes the gathered energy to power the upstroke of the subsurface pump. The transmission can vary upstroke speed apart from downstroke speed, pump stroke length and dwell time of change in stroke direction.

12 Claims, 2 Drawing Sheets

REGENERATIVE HYDRAULIC POWER TRANSMISSION FOR DOWN-HOLE PUMP

FIELD OF THE INVENTION

This invention relates to actuating mechanisms for subsurface pumps, and more particularly, to hydraulic pumping units which conserve energy.

BACKGROUND OF THE INVENTION

Pumping units for deep wells including water and oil wells, have been, for the most part, pumping units, both mechanical and hydraulic, having a counterweighted beam, or "horsehead." Rods, called sucker rods, extend from the surface to the downhole pump, and can weigh thousands of pounds. The counterweights responding to gravity across a pivot point from the rods balance the weight of the rods and attempt to smooth out the load on the prime mover for the pumping unit. Certain units have counterweights associated with the axle of the gearing so that the counterweight falls during upstroke of the subsurface pump. Some hydraulic units have been constructed using heavy counterweights and others utilize pneumatic accumulators which are pressured by downstroke and energy is released and utilized during upstroke.

The mechanical unit counterweights, which have considerable mass themselves, require equally massive frames, gearing and large high-power prime power sources to power the units. Considerable efficiency loss is experienced in such massive units. In hydraulic units, efficiency is lost through restrictor valves which control the speed of pumping. The speed of the unit and load imposed at various stages of polished rod movement are difficult to control while maintaining efficient power transmission. In pneumatic accumulator units, power from the accumulator varies from zero to a maximum during the power phase of the pump cycle. Smoothing the power input from such an accumulator is difficult.

SUMMARY OF THE INVENTION

The invention is a hydraulic power transmission for subsurface pumps which includes a power source, a hydraulic pump powered in part by the power source during upstroke and an inertial assist for the power source having means to gather energy from the downstroke to power in part the upstroke of the subsurface pump. The hydraulic pump at the surface reverses flow of hydraulic fluid during downstroke and gathers kinetic energy from the downstroke in a flywheel and the gathered energy is utilized in the upstroke of the subsurface pump. The inertial assist provides a substantially constant stored energy source for the entire up-and-down-stroke cycle of the subsurface pump.

BRIEF DESCRIPTION OF THE DRAWINGS

Reference is now made to the drawings, in which.

DESCRIPTION OF THE PREFERRED EMBODIMENT

Figure 1:
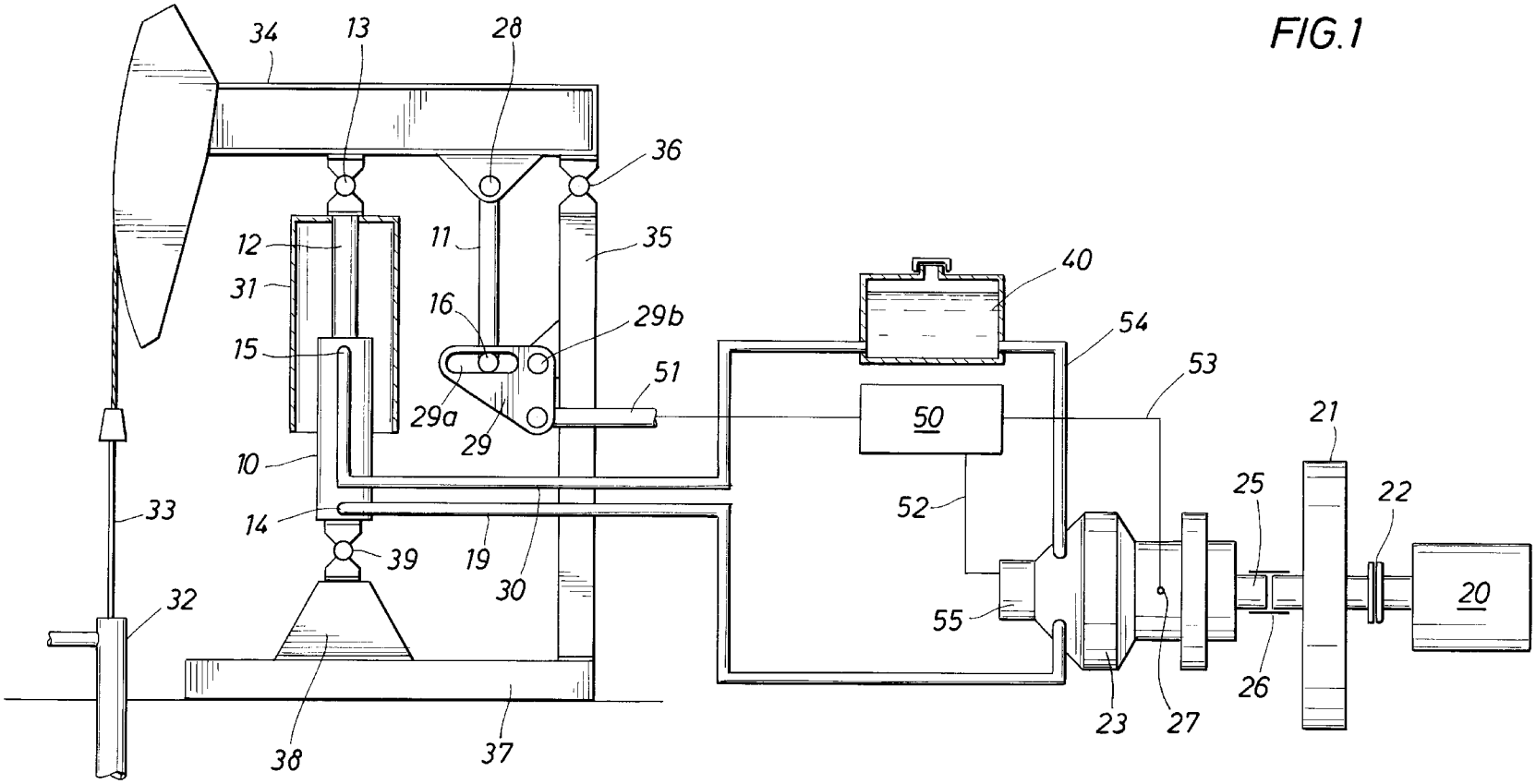
FIG. 1 is a schematic showing the relationship of the pump jack, lift cylinder hydraulic pump, controls and power source for the preferred embodiment.

A preferred embodiment of the invention is shown in FIG. 1 of the drawings. An oil or water well surface installation is shown having a well head 32, in which a polished rod 33 reciprocates. Polished rod 33 supports a string of sucker rods (not shown) which are attached to the piston of a subsurface well bore pump (32*a*). Such downhole sucker rod pumps are well known and used extensively in subsurface pumping applications. The piston of such subsurface pumps is operated by vertically reciprocating the sucker rod string suspended from polished rod 33 by up and down movement of the head of the pump jack beam 34. Pump jack beam 34 is supported for reciprocal movement by a samsom post 35 about a derrick bearing 36. Samsom post 35 rests on a platform 37. Platform 37 also supports a cylinder pad 38 on which rests a cylinder bearing 39. Cylinder bearing 39 supports the hydraulic lift cylinder 10, in which the hydraulic piston (not shown) is contained. The hydraulic piston (not shown) is connected to a hydraulic piston rod 12 joined at its other end by a piston rod bearing 13 to pump jack beam 34.

As hydraulic fluid is admitted to the fluid inlet 14 of hydraulic lift cylinder 10, the hydraulic piston (not shown) is urged upwardly and hydraulic piston rod 12 attached thereto causes pump jack beam 34 to pivot upwardly about derrick bearing 36 and cause an upstroke in polished rod 33, the sucker rods suspended therefrom and the piston of the subsurface pump (32*a*).

Hydraulic lift cylinder 10 also includes a hydraulic drain 15 connected by a hydraulic fluid tank 40. Since hydraulic lift cylinder 10 is a single-acting cylinder, hydraulic drain 15 merely serves to convey to the fluid reservoir 40 the hydraulic fluid which has seeped past the hydraulic piston (not shown) into the unpressured portion of lift cylinder 15. Hydraulic piston rod 12 may also be fitted with an appropriate dust shield 31.

Fluid inlet 14 of hydraulic lift cylinder 10 is fluidly connected to the hydraulic, or hydrostatic, pump 23 which obtains hydraulic fluid from fluid reservoir 40 and supplies the fluid to lift cylinder 10 during the subsurface pump upstroke. During downstroke of the subsurface pump, hydraulic fluid flows from lift cylinder 10 though hydraulic power line 19, through hydrostatic pump 23 and into fluid reservoir 40. The reversal of flow through hydrostatic pump 23 permits the capture of energy on the subsurface pump downstroke.

Figure 2:
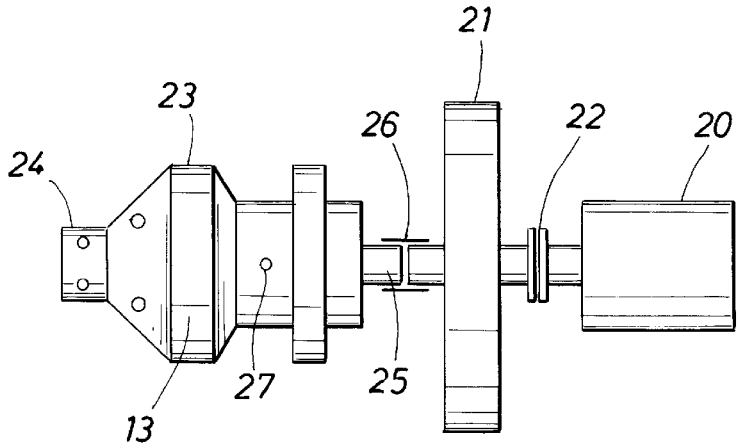
FIG. 2 is a schematic showing the power source, inertial assist and reversible hydraulic pump of the preferred embodiment.

In the more detailed FIG. 2, the power train of the system is shown. The power train includes a power source 20 and hydrostatic pump 23, a variable displacement, axial multipiston, reversible swashplate pump such as that available from Oilgear Company, Hydura model PVW or from Mannesmann Rexroth, model A(A)4VSGHW. Such pumps permit reversible flow variable fluid volume cycles and variable flow rates during such cycles depending upon the angle of the swash plate of the pump. Such pumps provide pressured fluid when flow is in a first direction, and when reversed, can extract energy from the reversed pressurized fluid by operating the pistons which transfer energy to a power shaft. Such pumps are well known and available for use in various positive displacement and high pressure applications.

The prime mover, or power source 20 may be a conventional internal combustion or electric motor or other power source, such as a windmill. If a windmill is used, the inertial assist, or flywheel, 21 may be incorporated into the rotating wind turbine, or be a separate mechanical element inserted into the power train. Flywheel 21 is connected to power source 20 by a flywheel clutch 22 which permits kinetic energy to be gradually added into flywheel 20 at startup of the pumping operation. The power from power source 20 and flywheel 21 is transmitted to hydrostatic pump 23 by a power shaft 25 through a power connector 26. Power shaft 25 rotates the fluid cylinders and pistons (not shown) which produces the flow of pressured hydraulic fluid in the system during subsurface pump upstroke. The swashplate of hydrostatic pump 23 (not shown) is utilized to control the rate, direction and volume of fluid through hydrostatic pump 23.

No restrictor valves are present in lift cylinder 10, hydraulic power line 19 or hydrostatic pump 23. The flow of hydraulic fluid to or from lift cylinder 10 is controlled by controller 50, which senses the position of pump jack beam 34 in FIG. 1, and relays that position to a swash plate setting mechanism, such as a mechanical swash plate stem driver (not shown) to set the swash plate by moving the swash plate stem 27 to the proper angle for desired direction and rate of flow.

In FIG. 1, a mechanical arrangement for sensing the position of pump jack beam 34 is shown. Following the motion and position of pump jack beam 34 is a timing rod 11, joined to pump jack beam 34 at a timing rod bearing 28. The lower end of timing rod 11 is joined to a timing lever 29 by a swiveling lock nut 11*a*. Timing lock nut 11*a* positions timing rod 11 in the timing slot 29*a* at a predetermined distance from a timing lever pivot 29*b* which is fixed for pivoting movement of timing lever 29 thereabout to a portion of samson post 35. Thus the position and movement of polished rod 33, pump jack beam 34 and timing rod 11 are transmitted through a controller rod 51 to controller 50. Timing lock nut 11 a may be fixed at different positions in timing slot 29*a* to cause greater or lesser movement of controller rod 51 in the mechanical sensing embodiment.

Controller 50 may be mechanical, hydraulic or electronic in operation, and its function is to sense the position of pump jack beam 34 as it moves the subsurface pump through upstroke and downstroke. In the mechanical embodiment shown in FIG. 1, the stroke stage of the subsurface pump is ultimately transmitted to controller 50 by the physical position of controller rod 51. Hydraulic, electronic or other sensing means, or combinations of mechanical hydraulic and electronic sensors of known types would suffice in the sensing and transmitting function.

Figure 3:
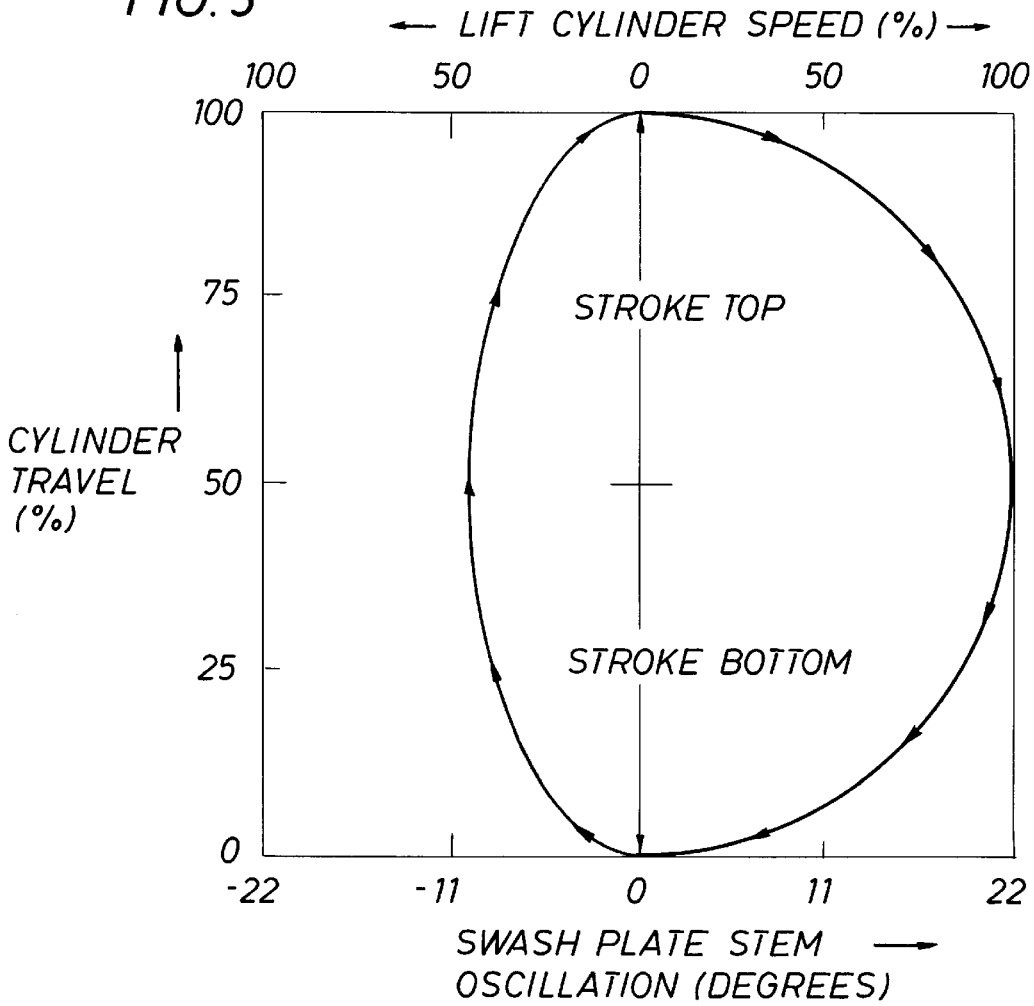
FIG. 3 is a graphical representation of stroke profile as a function of hydraulic pump swash plate movement.

Controller 50, after sensing the stage of stroke pump jack beam 34 then relays by appropriate means the setting for the swash plate angle in hydrostatic pump 23. In the Oilgear Hydura PVW in use in the present embodiment, when the position or angle of the swash plate is perpendicular to power shaft 25, there is zero flow of hydraulic fluid between hydrostatic pump 23 and lift cylinder 10. Referring now to FIG. 3, a graphical presentation of lift cylinder travel on the vertical axis to flow of hydraulic fluid to and from hydrostatic pump 23 and swashplate position is shown. At the top of upstroke of lift cylinder 10 (corresponding to apex of upstroke of the subsurface pump) and at the bottom of downstroke the swash plate of hydrostatic pump 23 is perpendicular to power shaft 25 and zero flow of hydraulic fluid is present. Depending upon the desired speed of upstroke and downstroke, the angle of the swash plate in hydrostatic pump 23 is urged away from the perpendicular relation to power shaft 25 so that at mid-upstroke or mid-downstroke of lift cylinder 10 and pump jack beam 34, the swash plate is at its maximum divergence (in negative and positive degrees, respectively) from perpendicularity with power shaft 25. At such position, flow is greatest between hydrostatic pump 23 and lift cylinder 10. As the piston in lift cylinder 10 approaches maximum up- or down-stroke position, the angle of swashplate stem 27 is rotated to move the swashplate nearer perpendicularity to power shaft 25, thereby slowing the speed of pump jack beam 34.

Reversal of flow in hydrostatic pump 23 occurs at maximum upstroke and downstroke of the subsurface pump and pump jack beam 34. FIG. 3 shows that deviation in angle of swash plate stem 27 (and therefore the swash plate) in one direction (reflected by negative degrees on the graph) produces flow from the hydrostatic pump to lift cylinder 10, and deviation of angle in the opposite direction utilizes flow from lift cylinder 10 to hydrostatic pump 23. In Oilgear Hydura model PVW, the swashplate may be deviated from perpendicularity to power shaft 25 by plus 22 degrees or minus 22 degrees. FIG. 3 shows a cycle of 11 degrees negative swashplate angle for upstroke and 22 degrees positive angle for downstroke. This is the "fast up-slow down" cycle.

An auxiliary hydraulic pump 55 may be added to the power train in hyddraulic or mechanical embodiments to furnish controller 50 fine control power to and in such functions as determining the speed of the pumping cycle and length of stroke of the piston within lift cylinder 10. As hydraulic fluid flows from hydrostatic pump 23 to lift cylinder 10, the pump jack beam is forced upward on the power stroke. Flywheel 21 and power source 20 supply the energy in the power stroke to power hydrostatic pump 23. Some of the energy of flywheel 21 is expended in the power stroke, and the speed of flywheel 21 and power source 20 slows slightly. As the subsurface pump and pump jack beam 34 reach the apex of the stroke, controller 50 has moved the position of the swashplate in hydrostatic pump 23 from a maximum negative angle away from perpendicularity to a position approaching perpendicularity.

One example of sizing of such a flywheel and its power source would be a 2500 pound disc flywheel turned at 2400 r.p.m. with a power source of a conventional internal combustion engine of 65 horsepower. When lifting a 8000 ft. string of sucker rods and fluid through a 12-foot stroke, only 176,000 foot-pounds would be expended. A substantial portion of that energy will be recaptured during downstroke when flow is forced by the falling rods through hydrostatic pump 23. During upstroke, the speed of the flywheel will diminish to approximately 2300 r.p.m. Approximately 156,000 foot-pounds of energy would come from the flywheel and approximately 20,000 foot-pounds would come from the prime mover. During downstroke, approximately 138,000 foot-pounds will be derived from the falling sucker rod mass and together with approximately 20,000 foot-pounds of energy from the prime mover, the flywheel will gather sufficient kinetic energy to again turn at 2400 r.p.m. When run in a prototype unit, energy savings were calculated to be approximately 29% compared with such a unit not utilizing a flywheel.

At perpendicularity of swash plate and power shaft 25 (corresponding to zero degrees of swash plate stem oscillation), fluid flow in hydrostatic pump 23 is reversed by controller 50. The weight of the sucker rods and pump jack beam 34 now cause the piston in lift cylinder 10 to descend and force hydraulic fluid from lift cylinder 10 through hydraulic power line 19 and through hydrostatic pump 23. The force of hydraulic fluid through hydrostatic pump 23 causes the power source and the inertial assist to speed up slightly as a result of the addition of kinetic energy from the falling sucker rods to the speed up of flywheel 21 and other turning masses in the power train. Thus, kinetic energy from the downstroke of the subsurface pump has been gathered and saved in flywheel 21 for utilization, after again reversing the fluid flow in hydrostatic pump 23, to aid in powering the upstroke of the subsurface pump.

Thus it can be seen that a novel and efficient power transmission for subsurface pumping has been shown.

Energy can be obtained during the downstroke of the pump and utilized in the power for the upstroke.

What is claimed is:

1. A hydraulic power transmission for subsurface pumps, comprising:

a power source;

a single reversible hydraulic pump in a single open-loop hydraulic circuit powered at least in part by said power source to cause said subsurface pump to upstroke; and, an inertial assist for said power source, including means for gathering energy from the downstroke of said subsurface pump and means for utilizing energy gathered during the downstroke to power at least in part the upstroke of said subsurface pump.

2. The power transmission as claimed in claim 1, wherein:

said power source, said hydraulic pump and said inertial assist are mechanically coupled to each other; rotate in the same direction and at the same speed about a common axis.

3. The power transmission as claimed in claim 1, wherein:

said inertial assist includes a flywheel.

4. The power transmission as claimed in claim 1, including:

means to vary the length of the downstroke and the upstroke of said subsurface pump.

5. The power transmission as claimed in claim 1, including:

means to vary the speed of one or both of upstroke and said downstroke of said subsurface pump.

6. A hydraulic power transmission for subsurface pumps, comprising:

a power source;

at least one lift cylinder for actuating the stroke of said subsurface pump;

a single reversible hydraulic pump fluidly connected in a single open-loop hydraulic circuit to said lift cylinder;

an inertial assist for said power source;

means for gathering kinetic energy from the downstroke of said subsurface pump and transferring the energy thus gathered to said inertial assist; and means to utilize the energy gathered in said inertial assist during the downstroke, along with said power source, to cause said subsurface pump to upstroke.

7. The power transmission as claimed in claim 6, wherein:

said power source, said hydraulic pump and said inertial assist are mechanically coupled to each other, rotate in the same direction and at the same speed about a common axis.

8. The power transmission as claimed in claim 6, wherein:

said inertial assist is a flywheel.

9. In a method for operating a subsurface pump connected to a surface power source, the combination of steps including:

gathering kinetic energy with a single reversible hydraulic pump in a single open-loop hydraulic circuit from the weight of load on the polished rod during the downstroke of a subsurface pump in an inertial assist mechanically and coaxially coupled with said hydraulic pump and the power source for said hydraulic pump; and, utilizing the kinetic energy gathered in said gathering step to power in part the upstroke of said subsurface pump in combination with said power source.

10. The method as claimed in claim 9, wherein said gathering step includes the additional step of:

reversing the flow of hydraulic fluid from the lift cylinder for said subsurface pump through said single hydraulic pump to increase the speed of said inertial assist.

11. The method as claimed in claim 9, including the additional step of:

adding kinetic energy to said inertial assist with said power source prior to said gathering and utilizing steps.

12. The method as claimed in claim 9, wherein said reversing step includes the additional steps of:

sensing the apex of upstroke of said subsurface pump;

causing flow of hydraulic fluid from said hydraulic pump to the lift cylinders to fall to zero at the apex of upstroke; and causing the hydraulic fluid to flow from the lift cylinder to said hydraulic pump during downstroke of the subsurface pump.

* * * * *